US005586610A

United States Patent [19]

Sajatovic

[11] Patent Number: 5,586,610

[45] Date of Patent: Dec. 24, 1996

[54] KELLY BAR HAVING HARDENED FLUTES

[75] Inventor: James N. Sajatovic, Nazareth, Pa.

[73] Assignee: Ingersoll-Rand Company, Woodcliff Lake, N.J.

[21] Appl. No.: 463,466

[22] Filed: Jun. 5, 1995

[51] Int. Cl.[6] ..... E21B 3/04

[52] U.S. Cl. ..... 175/195

[58] Field of Search ..... 175/113, 114, 175/122, 162, 170, 195

[56] References Cited

U.S. PATENT DOCUMENTS 3,561,545 2/1971 Rassieur ..... 172/195 X 4,393,945 7/1983 Rassieur ..... 175/122 X 5,062,490 11/1991 Rassieur .

5,368,083 11/1994 Beck, III .

*Primary Examiner*—William P. Neuder

*Attorney, Agent, or Firm*—John J. Selko

[57] ABSTRACT

A kelly bar for rotary drilling machines comprises a hollow, tubular, elongated body having a plurality of electric arc gouged flutes therein, each flute having a hardened, heat-affected zone beneath its bottom surface to provide improved wear.

8 Claims, 3 Drawing Sheets

KELLY BAR HAVING HARDENED FLUTES

BACKGROUND OF THE INVENTION

This invention relates generally to kelly bars used in rotary drilling operations, and more particularly to kelly bars having hardened flutes therein for improved wear.

Kelly bars are currently produced using a milling process to produce the flute pattern along the length of the bar. The machining process is slow, and, the microstructure of the body of the kelly bar remains substantially unhardened by the milling process. It would be advantageous to provide a kelly bar and method of production to produce a kelly bar having hardened flutes for improved wear.

The foregoing illustrates limitations known to exist in present kelly bars and production methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a kelly bar comprising: a hollow, tubular, elongated body having an outer surface, the body terminating in a first end and a second end; and a plurality of hardened flutes in the outer surface, each flute extending axially lengthwise along the body substantially the distance between the first and second end, each the flute extending radially inwardly into the body and terminating at a curved bottom surface, each flute having a hardened, heat-affected zone beneath the bottom surface.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

In the drilling industry, kelly bars are used to transmit the twisting torque from the rotary machinery to the drill tool. The outside cross section of the kelly bar can be square, octagonal or round. The square and octagonal cross sections provide corners for the rotary table to grip and apply rotary force. Kelly bars having a round outside cross section must have flutes machined in the outer surface of the body to provide grooves for gripping by the rotary table.

Figure 1:
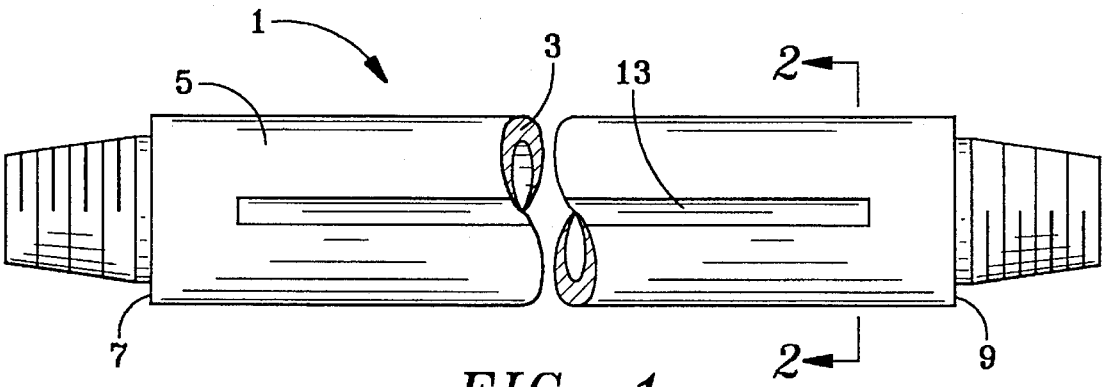
FIG. 1 is a side view of a kelly bar of this invention.
Figure 2:
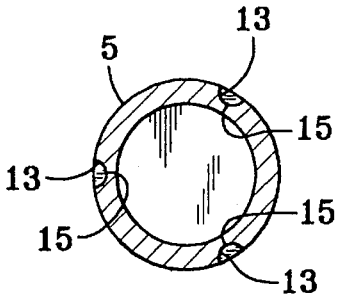
FIG. 2 is a view along B—B of FIG. 1.

FIG. 1 shows a kelly bar 1 having a hollow, tubular body 3 having an outer surface 5, and terminating in a first end 7 and a second end 9. A plurality of parallel, hardened flutes 13 are located in outer surface 5. Each flute 13 extends axially lengthwise along body 3 substantially the distance between first and second end, 7 and 9, respectively. As shown in FIG. 2, each flute 13 is a rounded groove, and extends radially inwardly into body 3 and terminates at a curved bottom surface 15. Each flute 13 has its greatest depth extending radially into body 3 and bottom surface 15 curves gradually upwardly and outwardly to outer surface 5.

Figure 3:
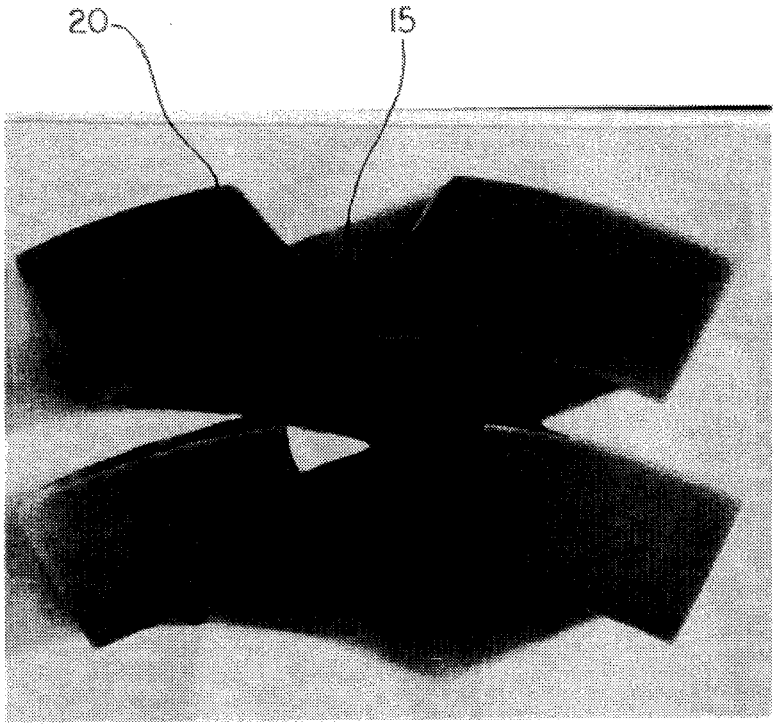
FIG. 3 is a photograph at 1.6× magnification, showing the heat-affected zone beneath a flute of the invention and the non heat-affected zone of a flute milled by prior art methods.
Figure 4:
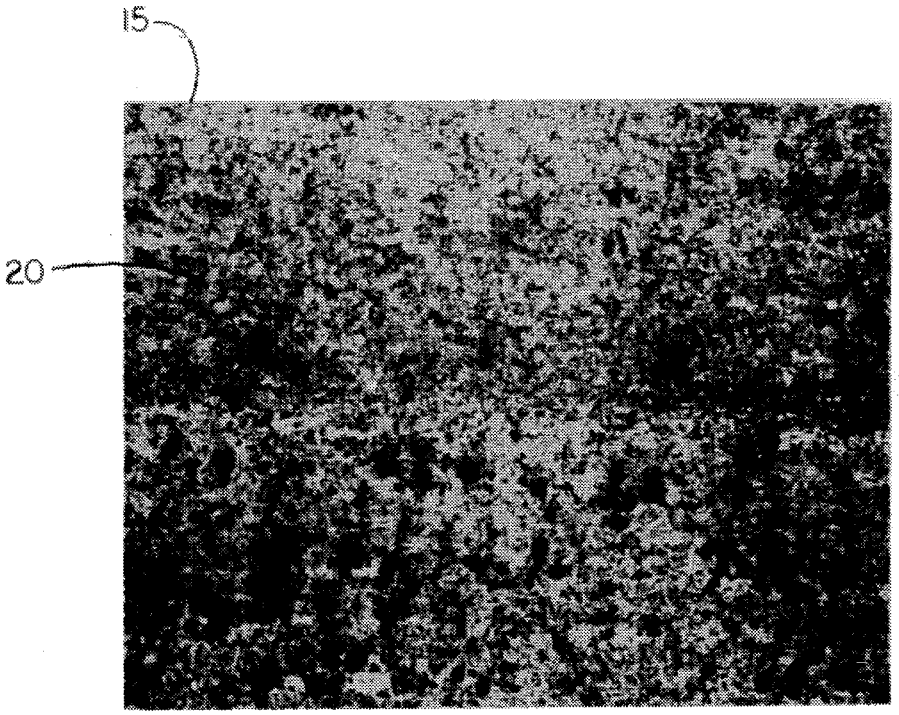
FIG. 4 is a photomicrograph at 100× magnification, showing the interface between a heat-affected zone and base metal.

As shown in FIGS. 3 and 4, each flute 13 has a hardened, heat-affected zone 20 beneath bottom surface 15. Heat-affected zone 20, will extend between 0.032 and 0.062 inches below bottom surface, when the method of this invention is used to produce flutes 13. As shown in FIG. 3, flute 13 does not have a heat-affected zone because it is produced by milling.

Figure 5:
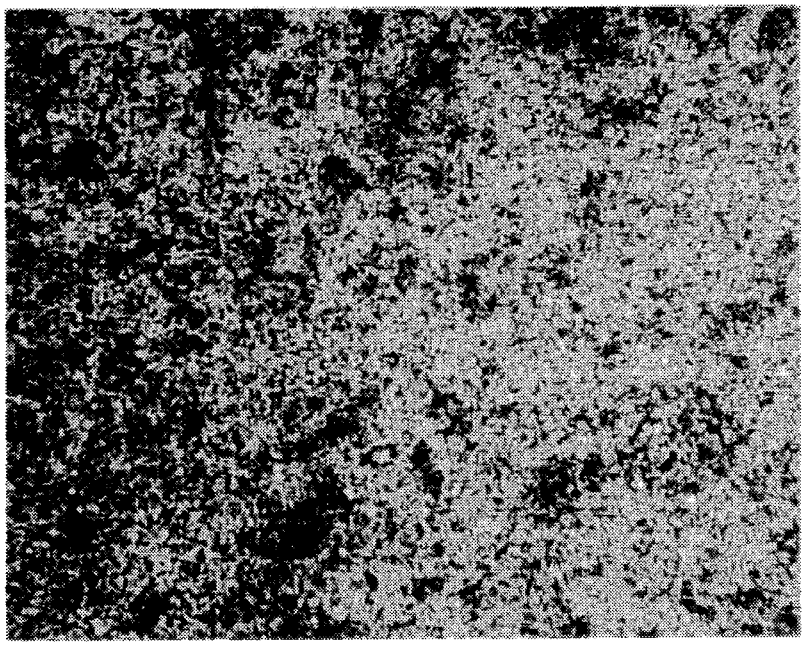
FIG. 5 is a photomicrograph at 400× magnification, showing the hardened martensitic microstructure in a heat-affected zone.
Figure 6:
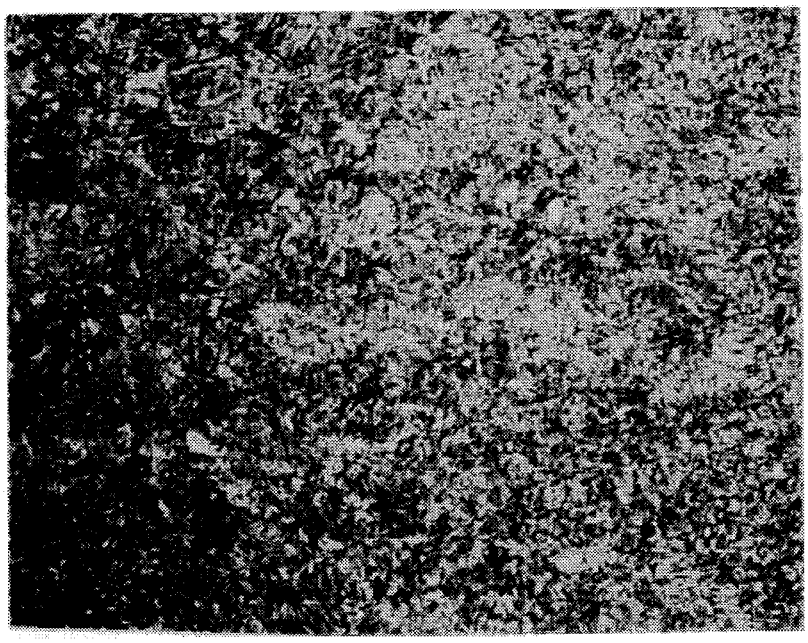
FIG. 6 is a photomicrograph at 400× magnification, showing the unhardened base metal microstructure adjacent to a flute milled according to prior art methods.

As shown in FIG. 5, body 3 has a first microstructure comprising finely dispersed martensite in heat-affected zone 20 adjacent to bottom surface 15. As shown in FIG. 6, body 3 has a second microstructure comprising a mixture of pearlite and bainite, away from the heat affected zone 20 and away from the bottom surface 15. This is also the same microstructure present in kelly bars before and after flutes 13 are milled therein.

The martensitic microstructure is produced by reason of the electric arc gouging method used to produce the flutes 13, as described hereinafter. The martensitic microstructure is harder and more wear resistant than the pearlitic/bainitic microstructure, providing an improved kelly bar. Conventional milling of flutes 13 will not produce the two different microstructures or the hardened heat-affected zone 20.

As is well known, kelly bars require specific strength properties, which dictate the composition of the material. It is preferred to use a carbon steel composition according to specification AISI 4130 which has the following weight percentage ranges of elements: C0.28/0.33; Mn0.40/0.60; P0.035 max.; S0.040 max.; Si0.15/0.30; Cr0.80/1.10; Mo0.15/0.25; balance residuals.

Unfluted kelly bar bodies are initially supplied as elongated, hollow tubes. With the conventional compositions used for kelly bars in the industry, the hardening of flutes produced by the method of this invention will produce a range of flute hardness between 40 to 50 Rockwell C in the heat-affected zone 20. Away from heat affected zone 20 the microstructure hardness will be in the range of 28 to 332 Rockwell C.

I prefer a kelly bar with three flutes 13 spaced equidistant from each other around outer surface 3, as shown in FIG. 1. More or fewer flutes can be used.

Figure 7:
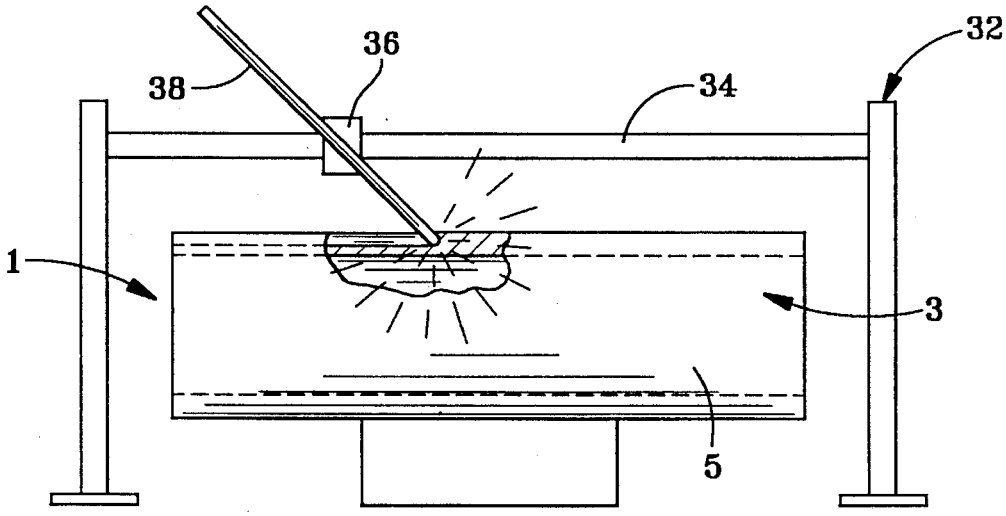
FIG. 7 is a schematic elevational view of a device for producing hardened flutes in kelly bars.

Now referring to FIG. 7, a device is shown schematically for practicing the method of this invention. This method is herein called electric arc gouging.

A kelly bar 1 to be fluted is placed horizontally below a carriage, 32. Carriage 32 has arm 34 extending axially along kelly bar 1. Mounted on arm 34 is a jig 36 that can move axially along arm 34. Jig 36 holds a conventional carbon electrode rod 38. Rod 38 is positioned adjacent outer surface 5. I prefer to position rod 38 at an angle of 45 degrees to the horizontal, and oriented axially along kelly bar body 3. An electrical arc is created between rod 38 and outer surface 5, to form a pool of melted material from body 3. Jig 36 and rod 38 are moved along arm 34, while air is blown against the molten pool of material to maintain the material molten and to blow it away. I prefer air at a standard industrial pressure of 80/90 psi. Other oxygen-containing gases can work, so long as the molten material temperature is maintained (or raised) so as to keep the pool of material molten. The microstructure below bottom surface 15 is cooled rapidly due to the mass of body 3, resulting in the martensitic structure. As the jig 36 and rod 38 move, rod 38 becomes consumed, and it is necessary to continuously adjust the position of rod 38 with respect to outer surface 5. This adjustment can be automated. Before the gouging is begun, kelly bar 1 can be coated with a suitable material to prevent splatter from adhering to the surface of body 3. Material that works is sold by Arcair Company, under the registered trademarks ARCAIR or PROTEX.

I prefer to gouge flutes by using an automatic gouging unit provided by Tweco Products Inc. of Wichita, Kan., under the product designation of N6000 Automatic Gouging Unit.

Upon completion of one flute, the kelly bar 1 is rotated the desired amount, the carbon electrode rod 38 is repositioned next to outer surface 5, and the steps are repeated. Any number of flutes 13 can be so produced. I prefer to move rod 38 axially at a rate of 30 to 45 inches per minute. This compares to a milling rate of 5 inches per minute, providing improved productivity of kelly bars. I prefer to create the electrical arc at about 1100 amps and about 42 volts, but other power settings suitable for electrical arc gouging will work.

Having described the invention, what is claimed is:

1. A kelly bar comprising:

(a) a hollow, tubular, elongated body having an outer surface, said body terminating in a first end and a second end;

(b) an electric arc gouged flute in said outer surface, extending axially lengthwise along said body substantially the distance between said first and second end, said flute extending radially inwardly into said body and terminating at a curved bottom surface; and (c) said body having a first microstructure at said flute bottom surface and a second microstructure away from said flute bottom surface, said first microstructure comprising a heat-affected zone having a hardness greater than a hardness of said second microstructure.

2. The kelly bar of claim 1 wherein said body comprises a carbon steel, said first microstructure comprises finely dispersed martensite and said second microstructure comprises a mixture of pearlite and bainite.

3. The kelly bar of claim 2 wherein said heat affected zone extends approximately 0.032 to 0.062 inches below said bottom surface.

4. The kelly bar of claim 3 wherein said first microstructure hardness is in the range of 40 to 50 Rockwell C and said second microstructure hardness is in the range of 28 to 32 Rockwell C.

5. The kelly bar of claim 1 wherein said body includes a plurality of gouged flutes therein.

6. The kelly bar of claim 5 wherein said body comprises an analysis of AISI 4130 carbon steel.

7. The kelly bar of claim 6 wherein said body is circular in radial cross section, and said flutes are spaced equidistance apart around said outer surface.

8. The kelly bar of claim 7 wherein there are three flutes and said flutes are spaced apart about 120 degrees from each other.

* * * * *